US006705843B1

(12) United States Patent
Kuo

(10) Patent No.: US 6,705,843 B1
(45) Date of Patent: Mar. 16, 2004

(54) NVH AND GAS PULSATION REDUCTION IN AC COMPRESSOR

(75) Inventor: Fwutsai J. Kuo, Novi, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/272,625

(22) Filed: Oct. 17, 2002

(51) Int. Cl.[7] ..... F04B 53/00; F04B 1/12; F01N 7/10

(52) U.S. Cl. ..... 417/312; 417/269; 181/403; 181/240

(58) Field of Search ..... 181/403, 264, 181/282, 275, 240, 229, 272, 202; 417/269, 312, 540

(56) References Cited

U.S. PATENT DOCUMENTS

| | | | | |
|---|---|---|---|---|
| 3,817,661 A | * | 6/1974 | Ingalls et al. | 417/312 |
| 4,930,995 A | * | 6/1990 | Suzuki et al. | 417/312 |
| 4,936,754 A | * | 6/1990 | Suzuki et al. | 417/269 |
| 5,244,355 A | * | 9/1993 | Fujii et al. | 417/269 |
| 5,466,129 A | * | 11/1995 | Fukai | 417/269 |
| 5,645,405 A | | 7/1997 | Ota et al. | |
| 5,702,236 A | | 12/1997 | Ikeda | |
| 5,704,769 A | * | 1/1998 | Michiyuki et al. | 417/269 |
| 6,293,768 B1 | | 9/2001 | Shintoku et al. | |
| 6,382,938 B1 | | 5/2002 | Murao et al. | |
| 6,390,786 B1 | | 5/2002 | Gennami et al. | |
| 6,402,483 B1 | | 6/2002 | Kawamura et al. | |

FOREIGN PATENT DOCUMENTS

| | | |
|---|---|---|
| EP | 1033492 | 9/2000 |
| EP | 1184569 | 3/2002 |

* cited by examiner

*Primary Examiner*—Justine R. Yu
*Assistant Examiner*—Timothy P. Solak
(74) *Attorney, Agent, or Firm*—Brinks Hofer Gilson & Lione

(57) ABSTRACT

A muffler is integrally incorporated into the rear housing of a compressor. In this way, the muffler reduces the overall size, weight and cost of the compressor. The fluid flow is directed through the muffler and discharge chamber in such a way as to fully utilize the volume effectively to reduce flow turbulence, while not causing any significant flow loss or delay in fluid supply.

20 Claims, 3 Drawing Sheets

NVH AND GAS PULSATION REDUCTION IN AC COMPRESSOR

FIELD OF THE INVENTION

The present invention relates generally to compressors, and more particularly relates to mufflers for reducing noise in compressors.

BACKGROUND OF THE INVENTION

Existing compressors, such as air conditioning compressors found in vehicles, are relatively noisy. Accordingly, many compressors include a built-in flow noise control device or muffler. Unfortunately, these devices are usually a bulky addition to the compressor casting or housing, increasing the overall size and mass of the compressor significantly. Furthermore, these mufflers typically communicate with the discharge flow or the suction flow through a long and narrow passage. This passage is strictly a communication channel, and does not direct flow in a manner that effectively utilizes the interior of the muffler. One drawback includes a large flow loss due to the structure of the communication channel. Flow loss refers to a pressure loss in the flow due to the restricted flow passage. The more flow loss, the more power is required to compress same amount of refrigerant through a passage. Therefore, there exists a need to provide a muffler for a compressor that not only reduces the flow loss through the muffler, but which also reduces the overall size, weight and cost of the compressor.

BRIEF SUMMARY OF THE INVENTION

The present invention provides a muffler for a compressor that is incorporated into the existing rear housing portion of the compressor housing. In this way, the present invention provides a compressor which has reduced size and weight compared to existing compressors with external mufflers, mufflers as well as reducing the amount of flow loss. In turn, the efficiency of the compressor is increased (i.e. lower power consumption) due to streamlined flow with less turbulence. Additionally, the integral muffler adds stiffness to the rear housing that attributes to lower vibration. Preferably, a muffler chamber is defined within a discharge chamber, and the discharge chamber is further sub-divided into first and second portions. Discharge flow entering the first portion of the discharge chamber must flow through the muffler chamber before reaching the second portion of the discharge chamber for exit through a discharge port. Generally, the muffler chamber is defined by a muffler wall which includes restrictions to regulate the flow from the first portion to the second portion of the discharge chamber. Additional features include further subdividing the discharge chamber into several smaller cavities, as well as providing high pressure fluid directly to the second portion and discharge port.

BRIEF DESCRIPTION OF THE DRAWINGS

The accompanying drawings incorporated in and forming a part of the specification illustrate several aspects of the present invention, and together with the description serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
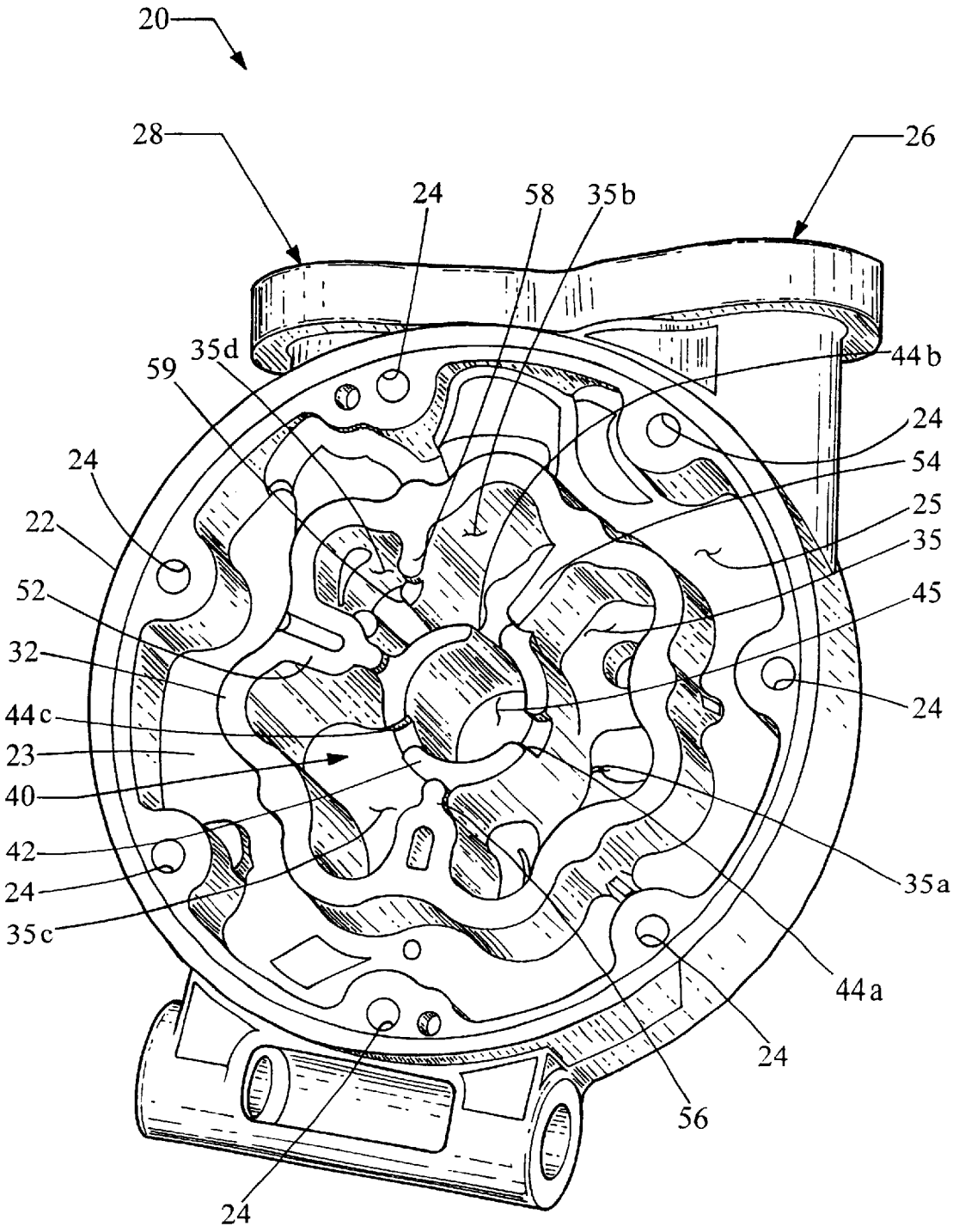
FIG. 1 is a perspective view of a rear housing and muffler constructed in accordance with the teachings of the present invention; [insert a brief description of each drawing, being sure that each drawing is separately labeled (e.g., 1, 2A, 2B, 3, 4, etc.) and individually described].
Figure 2:
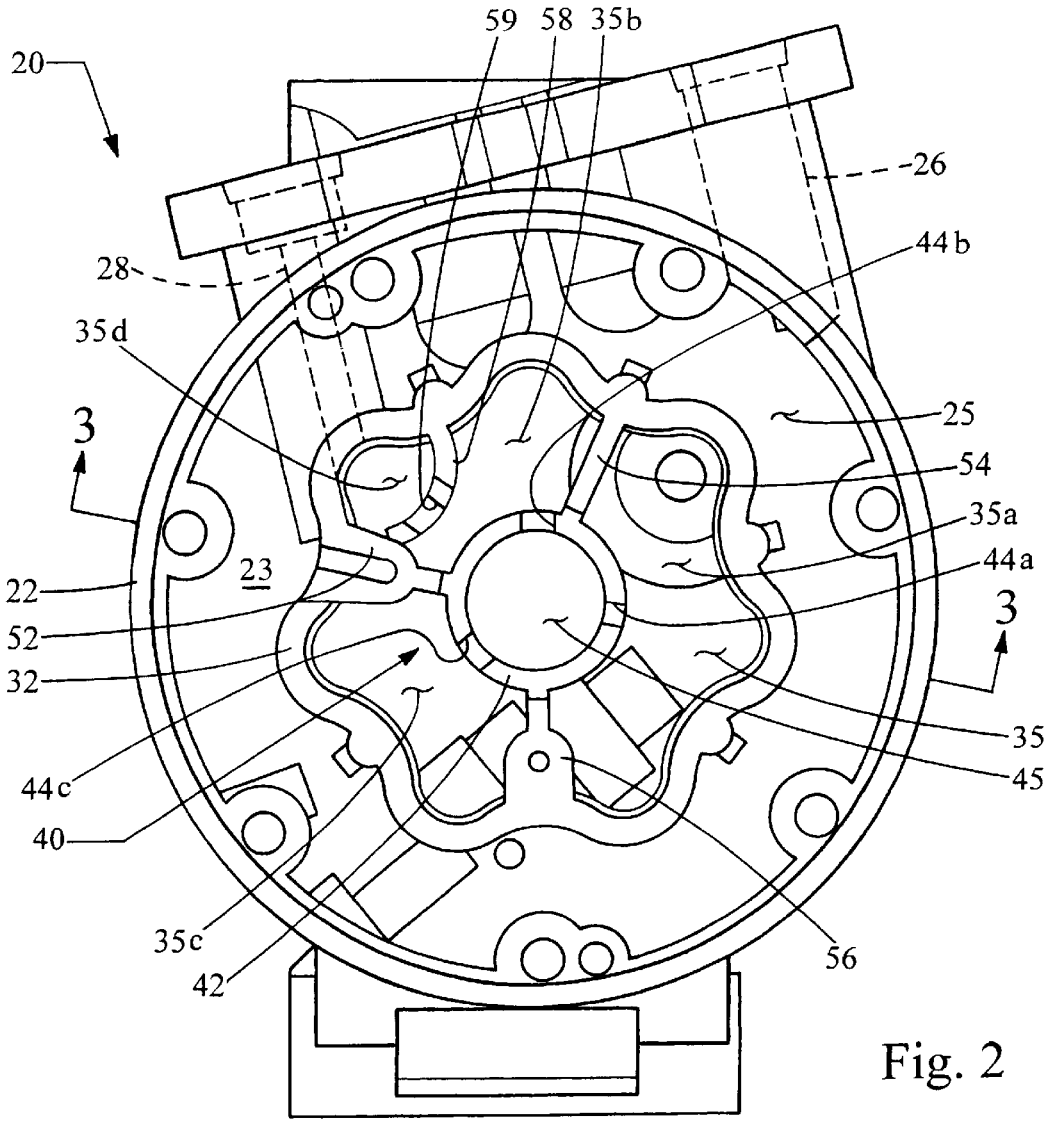
FIG. 2 is a top view of the rear housing and muffler depicted in FIG. 1.
Figure 3:
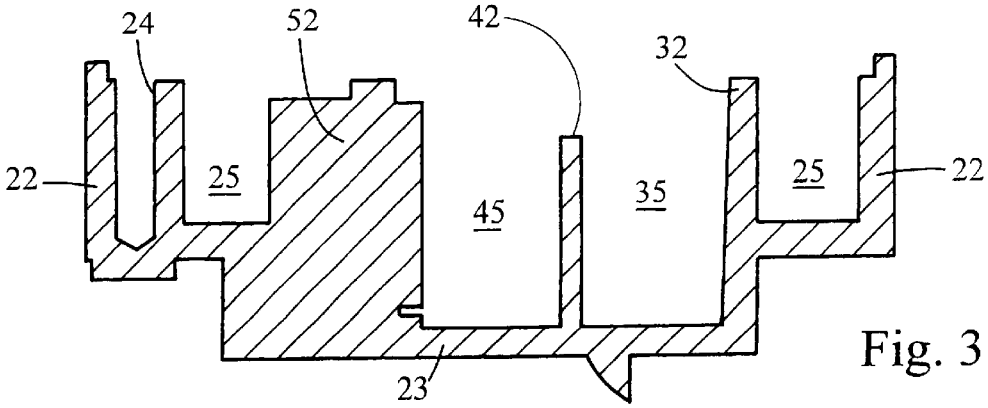
FIG. 3 is a cross-sectional view taken about the line 3—3 of FIG. 2.

Turning now to the figures, FIGS. 1–3 illustrate a rear housing 20 having a muffler 40 for reducing the noise, vibration and harshness in a compressor (not shown). Generally, the muffler 40 provides a damping effect to reduce the turbulence of fluid flow, as well as any pulsations in the flow. As a result of reduced flow turbulence and pulsations, the noise and vibration are reduced. Further, the efficiency of the compressor is increased due to the streamlined flow having less turbulence.

The rear housing 20 forms one element of a housing for the compressor. The rear housing 20 includes an end wall 26 and is positioned at one end of the compressor for communicating flow into and out of the compressor. The rear housing 20 includes an outer wall 22 extending axially from the end wall 26 around its outer periphery. The outer wall 22 is annular in shape. As used herein, "annular" refers to a ring-shape structure (i.e. having no particular beginning or end), although not necessarily circular.

Figure 4:
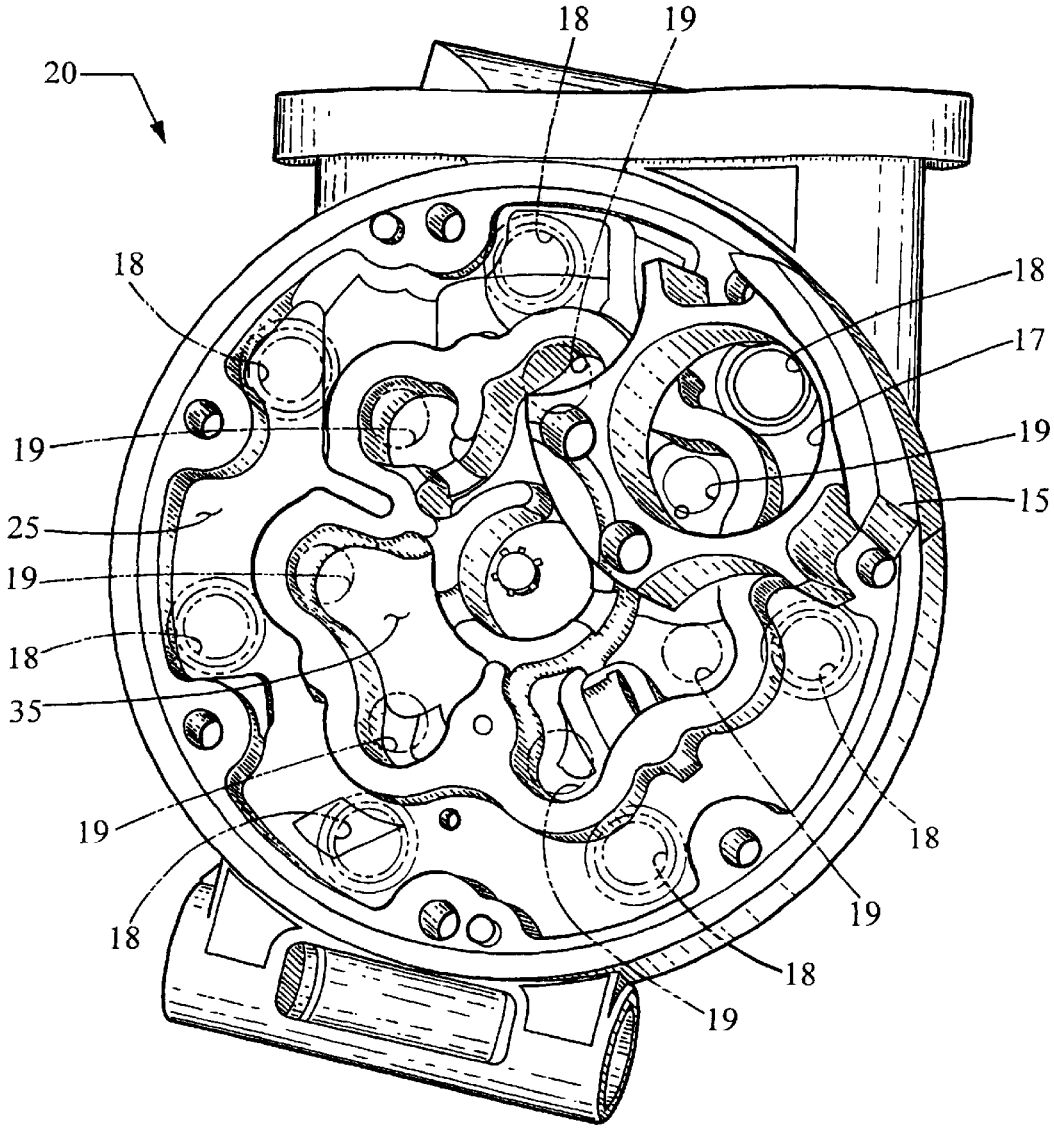
FIG. 4 is a perspective view similar to FIG. 1, but depicting a portion of a cylinder block partially cut away.

The outer wall 22 defines a plurality of female connectors shown as threaded openings 24. Typically, a threaded fastener is utilized to connect the rear housing 20 to the main housing by way of the threaded openings 24. As shown in FIG. 4, the rear housing is positioned immediately downstream of a cylinder block 15 containing a plurality of pistons (not shown) reciprocating within their respective bores 17. The cylinder block 15 has been shown partially cut-away in FIG. 4. As will be described in more detail herein, the rear housing 20 supplies low pressure fluid to the compressor, and more particularly the piston bores 17, as well as directs high pressure fluid produced by the compressor and discharged via the bores 17.

To accomplish the above, an inner wall 32 is formed within the rear housing 20. As with the outer wall 22, the inner wall 32 extends axially from the end wall 26 of the rear housing 20. The inner wall 32 is completely circumscribed by the outer wall 22. The inner wall 32 is annular in shape, and more specifically the inner wall 32 is flower-shaped, having a plurality of peaks and troughs to facilitate cooperation with the input and output of the cylinder bores 17, as shown in FIG. 4. The volume between the outer wall 22 and the inner wall 32 defines a suction chamber 25 which is utilized to supply low pressure fluid to the compressor. The supply of low pressure fluid is provided via a suction port 26 which is in fluid communication with the suction chamber 25, as best seen in FIG. 2. Within the inner wall 32, and as will be described in more detail herein, a discharge chamber 35 is formed for receiving high pressure fluid from the compressor. The discharge chamber 35 is in fluid communication with a discharge port 28 as shown by the dotted lines of FIG. 2.

In accordance with the present invention, a muffler 40 is integrally formed within the rear housing 20 to reduce the noise, vibration and harshness of the fluid flow. As shown in the figures, the muffler 40 includes a muffler wall 42 that extends axially from the end wall 26. The muffler wall 40 is annular in shape, and as shown in the figures, is preferably circular in shape. The muffler wall 42 is located within the inner wall 32 and is completely circumscribed thereby. Thus, the muffler chamber 45 is completely circumscribed by the discharge chamber 35. Accordingly, the discharge chamber 35 is best defined as the volume between the inner wall 32 and the muffler wall 42, although it will be recognized that discharge fluid does flow through both the discharge chamber 35 and muffler chamber 45. Thus, the discharge chamber 35 is ring-shaped and is completely circumscribed by the suction chamber 25. The muffler wall 42 defines an interior volume defined as the muffler chamber 45.

As the muffler 40 is incorporated into the rear housing 20 and the discharge chamber 35, it can be seen that the total outside dimensions of the rear housing 20 remain unchanged. The aforementioned walls (as well as the chambers, ports and channels that they define to direct the fluid flow) are cast directly into the rear housing 20, which eliminates any additional machining operations. Further, the refrigerant flow is directed to flow through the discharge chamber 35 in muffler 40 in such a way as to fully utilize the internal volume effectively, reducing flow turbulence and pulsations which in turn reduces the noise and vibration. The integral formation of the muffler adds stiffness to the rear housing that attributes to lower vibration.

For directing the flow, at least two divider walls 52, 54 extend between the muffler wall 42 and the inner wall 32. As shown in the figures, the illustrated embodiment of the rear housing 20 and muffler 40 includes a third divider wall 56 that extends between the muffler wall 42 and the inner wall 32. The divider walls 52, 54, 56 are spaced apart to subdivide the discharge chamber 35 into first, second and third portions denoted as 35*a*, 35*b* and 35*c*, respectively. The second portion 35*b* of the discharge chamber 35 is fluidically connected with the discharge port 28 for the transfer of high pressure fluid. The first and third portions 35*a*, 35*c* of the discharge chamber 35 are not in direct fluid communication with each other or the second portion 35*b*, but rather are in fluid communication with the muffler chamber 45. As best seen in FIG. 1, the muffler wall 42 includes a first opening 44*a* connecting the first portion 35*a* to the muffler chamber 45. The muffler wall 42 also defines a second opening 44*b* fluidically connecting the second portion 35*b* to the muffler chamber 45. As the muffler wall 42 is completely annular, it has a wall portion positioned between the second portion 35*b* of the discharge chamber 35 and the muffler chamber 45. Finally, the muffler wall 42 defines a third opening 44*c* fluidically connecting the third portion 35*c* to the muffler chamber 45.

In the illustrated embodiment, the second portion 35*b* of the discharge chamber 35 further includes a shield wall 58 within the second portion 35 to define a shield chamber 35*d*. The shield wall 58 includes an opening 59 fluidically connecting the second portion 35*b* of the discharge chamber 35 to the shield chamber 35*d*. The shield chamber 35*d* is directly connected for fluidic communication with the discharge port 28.

In operation, the cylinder bores 17 suck fluid from the suction chamber 25 at a relatively low pressure (supplied by suction port 26). The compressor and its cylinder pistons pressurize the fluid and discharge relatively high pressure fluid into the discharge chamber 35. As shown in FIG. 4, the cylinder block 15 includes a plurality of cylinder bores 17. At one end of each bore 17 the cylinder block 15 defines a suction opening 18 and a discharge opening 19. Typically, the flow through the suction openings 18 and the discharge openings 19 are regulated by one-way valves to ensure the proper direction of flow. As illustrated, the rear housing 20 is designed for use with a cylinder block 15 having seven cylinder bores 17 and seven sets of suction and discharge openings 18, 19.

Accordingly, it can be seen that the compressor discharges high pressure fluid through the discharge openings 19 into the discharge chamber 35, and more particularly into the first portion 35*a*, second portion 35*b*, third portion 35*c*, and the shield chamber 35*d*. The high pressure fluid in the first and third portions 35*a*, 35*c* of the discharge chamber 35 are required to flow through the first and third openings 44*a*, 44*c* and into the muffler chamber 45. This fluid flow then follows a path through the second opening 44*b* in the muffler wall 42 and into the second portion 35*b* of the discharge chamber 35. Flow then follows a path through the opening 59 in the shield wall 58 into the shield chamber 35*d* and exits via the discharge port 28 which is directly in communication with the shield chamber 35*d*.

This flow path defined by the muffler wall 42, divider walls 52, 54, 56, shield wall 58, and their respective openings, acts to reduce the turbulence and pulsations in the discharge flow, thereby reducing the noise and vibration of the compressor. The openings 44*a*, 44*b*, 44*c* in muffler wall 42, as well as opening 59 in shield wall 58, act as restrictions which regulate the flow from one chamber to the next. While these restrictions do not substantially change the pressure of the fluid or its flow rate, these restrictions do have a dampening effect of reducing the turbulence and pulsations in the fluid flow. It will be recognized that the efficiency of the compressor is increased (i.e. lower power consumption) due to streamlined flow with less turbulence. Preferably, openings 44*a* and 44*c* are notches in an upper end of the muffler wall 42, and are generally smaller than the larger opening 44*b*, which is also a notch in the muffler wall 42. Preferably, opening 59 is also a large notch formed in the shield wall 58.

The first and second portions 35*a*, 35*b* of the discharge chamber 35 are in fluid communication only through the muffler chamber 45. The restrictions are sized to reduce the turbulence of the fluid flow. Similarly, the third portion 35*c* and second portion 35*b* of the discharge chamber 35 are not in direct fluid communication. The restrictions attenuate the turbulence of the fluid flow from the first and third portions 35*a*, 35*c* of the discharge chamber to the second portion 35*b* of the discharge chamber 35.

It will also be recognized that the compressor and one or two piston cylinders 17 directly provide high pressure fluid to the second portion 35*b* of the discharge chamber, which is proximate the discharge port 28. When the shield wall 58 is employed as shown, one discharge opening 19 provides high pressure fluid directly to the shield chamber 35*d* which is in direct fluid communication with the discharge port 28. Thus, the supply of high pressure fluid is not delayed or compromised by the muffler 40 of the present invention.

Accordingly, it will be recognized by those skilled in the art that the present invention provides a muffler which is integrally incorporated into the rear housing of a compressor. In this way, the muffler reduces the overall size, weight and cost of the compressor. Additionally, the integral muffler adds stiffness to the rear housing that attributes to lower vibration. Furthermore, additional machining operations are not required as the muffler can be cast directly into the rear housing. Finally, the refrigerant flow is directed through the discharge chamber and muffler in such a way as to fully utilize the volume effectively to reduce flow turbulence, while not causing any significant flow loss or delay in fluid supply. In turn, the efficiency of the compressor is increased (i.e. lower power consumption) due to streamlined flow with less turbulence.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A rear housing for a compressor, the compressor having a cylinder block receiving low pressure fluid from the rear housing via a plurality of suction openings, the cylinder block providing high pressure fluid to the rear housing via a plurality of discharge openings, the rear housing comprising:

an annular inner wall;

an annular muffler wall circumscribed by the inner wall, the muffler wall defining a muffler chamber;

a discharge chamber defined between the muffler wall and the inner wall, the discharge chamber in fluid communication with a discharge port for transmitting high pressure fluid;

a first divider wall and a second divider wall extending between the muffler wall and the inner wall, the first and second divider walls being spaced apart to define first and second portions of the discharge chamber, the second portion of the discharge chamber communicating with the discharge port; and the muffler wall defining a first restriction between the first portion of the discharge chamber and the muffler chamber, the muffler wall defining a second restriction between the second portion of the discharge chamber and the muffler chamber, the restrictions attenuating the turbulence of the fluid flow from the first portion to the second portion through the muffler chamber.

2. The rear housing of claim 1, wherein the first and second restrictions are formed by openings in the muffler wall.

3. The rear housing of claim 2, wherein the openings are notches formed into the muffler wall.

4. The rear housing of claim 1, further comprising shield wall positioned within the second portion of the discharge chamber to define a shield chamber fluidically connected to the discharge port, the shield wall defining a shield restriction between the second portion of the discharge chamber and the shield chamber.

5. The rear housing of claim 1, further comprising a third divider wall extending between the muffler wall and the inner wall to define a third portion of the discharge chamber, the muffler wall defining a third restriction between the third portion of the discharge chamber to the muffler chamber.

6. The rear housing of claim 1, wherein at least one of the plurality of discharge openings provides high pressure fluid directly to the second portion of the discharge chamber.

7. A muffler for a compressor, the compressor including a housing having a rear housing defining an end of the housing, the rear housing including an annular outer wall circumscribing an annular inner wall to define a suction chamber and a discharge chamber, the suction chamber fluidically connected to a suction port and a plurality of suction openings for intake of low pressure fluid, the discharge chamber fluidically connected to a discharge port and a plurality of discharge openings for output of high pressure fluid, the muffler comprising:

an annular muffler wall formed into the rear housing to define a muffler chamber positioned within the discharge chamber;

a first divider wall and a second divider wall extending between the muffler wall and the inner wall, the first and second divider walls being spaced apart to define first and second portions of the discharge chamber, the second portion of the discharge chamber being fluidically connected to the discharge port; and the muffler wall defining a first opening and a second opening, the first opening fluidically connecting the first portion of the discharge chamber to the muffler chamber, the second opening fluidically connecting the second portion of the discharge chamber to the muffler chamber.

8. The muffler of claim 7, wherein the muffler wall is positioned between the first portion of the discharge chamber and the muffler chamber, and wherein the muffler wall is positioned between the second portion of the discharge chamber and the muffler chamber.

9. The muffler of claim 7, wherein the discharge chamber is completely circumscribed by the suction chamber.

10. The muffler of claim 7, wherein the first and second portions of the discharge chamber are in fluid communication only through the muffler chamber.

11. The muffler of claim 7, wherein the muffler wall and first opening form a first restriction, and wherein the muffler wall and second opening form a second restriction, the first and second restrictions regulating the fluid flow from the first portion of the discharge chamber to the second portion of the discharge chamber.

12. The muffler of claim 11, wherein the first and second restrictions are sized to reduce the turbulence of the fluid flow.

13. The muffler of claim 7, wherein at least one of the plurality of discharge openings provides high pressure fluid directly to the second portion of the discharge chamber.

14. The muffler of claim 7, further comprising a third divider wall extending between the muffler wall and the inner wall to define a third portion of the discharge chamber, the muffler wall including a third opening fluidically connecting the third portion of the discharge chamber to the muffler chamber.

15. The muffler of claim 14, wherein the second and third portions of the discharge chamber are not in direct fluid communication.

16. The muffler of claim 7, further comprising shield wall positioned within the second portion of the discharge chamber to define a shield chamber, the shield wall including a shield opening fluidically connecting the second portion of the discharge chamber to the shield chamber, the shield chamber being fluidically connected to the discharge port.

17. A muffler for a compressor, the compressor including a housing having a rear housing defining an end of the housing, the rear housing including an annular outer wall circumscribing an annular inner wall to define a suction chamber and a discharge chamber, the suction chamber fluidically connected to a suction port and a plurality of suction openings for intake of low pressure fluid, the discharge chamber fluidically connected to a discharge port and a plurality of discharge openings for output of high pressure fluid, the muffler comprising:

an annular muffler wall formed into the rear housing to define a muffler chamber within the discharge chamber;

a first divider wall and a second divider wall extending between the muffler wall and the inner wall, the first and second divider walls being spaced apart to define first and second portions of the discharge chamber, the second portion of the discharge chamber being fluidically connected to the discharge port;

the first and second portions of the discharge chamber being in fluid communication only through the muffler chamber; and at least one of the plurality of discharge openings providing high pressure fluid directly to the second portion of the discharge chamber.

18. The muffler of claim 17, wherein at least one of the plurality of discharge openings provides high pressure fluid to the first portion of the discharge chamber for passage through the muffler chamber and second portion of the discharge chamber for exit via the discharge port.

19. The muffler of claim 17, wherein the muffler wall defines a first restriction and a second restriction, the first restriction regulating the fluid flow from the first portion of the discharge chamber to the muffler chamber, the second restriction regulating the fluid flow from the second portion of the discharge chamber to the muffler chamber.

20. The muffler of claim 17, further comprising shield wall positioned within the second portion of the discharge chamber to define a shield chamber, the shield wall including a shield restriction fluidically connecting the second portion of the discharge chamber to the shield chamber, the shield chamber being fluidically connected to the discharge port.

* * * * *